US007661348B2

(12) United States Patent
Murello

(10) Patent No.: US 7,661,348 B2
(45) Date of Patent: Feb. 16, 2010

(54) EXCHANGEABLE BARREL MODULES FOR FIREARMS

(75) Inventor: Johannes Murello, Desslingen (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 11/925,402

(22) Filed: Oct. 26, 2007

(65) Prior Publication Data

US 2008/0216378 A1 Sep. 11, 2008

Related U.S. Application Data

(63) Continuation of application No. PCT/EP2006/003590, filed on Apr. 19, 2006.

(51) Int. Cl.
*F42C 17/00* (2006.01)

(52) U.S. Cl. ..... 89/6.5; 89/6

(58) Field of Classification Search ..... 89/6.5; 42/75.02

See application file for complete search history.

(56) References Cited

U.S. PATENT DOCUMENTS

| | | | | | |
|---|---|---|---|---|---|
| 2,465,351 | A | * | 3/1949 | Busignies et al. | 102/209 |
| 3,557,482 | A | | 1/1971 | Hoover | |
| 3,854,231 | A | * | 12/1974 | Broyles | 42/84 |
| 3,958,510 | A | * | 5/1976 | Stutzle | 102/209 |
| 4,022,102 | A | * | 5/1977 | Ettel | 89/6.5 |
| 4,080,869 | A | * | 3/1978 | Karayannis et al. | 89/6.5 |
| 4,142,442 | A | | 3/1979 | Tuten | |
| 4,214,534 | A | * | 7/1980 | Richter et al. | 102/215 |
| 4,283,989 | A | * | 8/1981 | Toulios et al. | 89/6.5 |
| 4,561,204 | A | * | 12/1985 | Binion | 42/122 |
| 4,649,796 | A | * | 3/1987 | Schmidt | 89/6.5 |
| 4,664,013 | A | * | 5/1987 | Wegner et al. | 89/6.5 |
| 4,711,152 | A | | 12/1987 | Fortunko | |
| 4,911,060 | A | * | 3/1990 | Greenspan et al. | 89/14.05 |
| 4,949,089 | A | * | 8/1990 | Ruszkowski, Jr. | 342/52 |
| 4,989,359 | A | | 2/1991 | Kinkner et al. | |

(Continued)

FOREIGN PATENT DOCUMENTS

| | | |
|---|---|---|
| DE | 4214059 | 11/1993 |

(Continued)

OTHER PUBLICATIONS

Wilhelm, R. "Zunkunftsvision Das Heckler & Koch OICW", Soldat Und Technik, Report-Verlag, Frankfurt AM Main, De, vol. 44, No. 11, Nov. 2001, pp. 34-39, XP001110399.

(Continued)

*Primary Examiner*—Michael Carone
*Assistant Examiner*—Jonathan C Weber
(74) *Attorney, Agent, or Firm*—Hanley, Flight and Zimmerman, LLC

(57) ABSTRACT

A method and apparatus are described for an exchangeable barrel module for a firearm equipped with the same. An example firearm includes an exchangeable barrel module, which includes a barrel and a barrel jacket. The barrel module also includes a range finder, control electronics, a transmitter to transfer the result of the control electronics to a projectile, an operating element, and a power supply. Further, the barrel jacket holds the barrel and at least a portion of the range finder, the control electronics, the transmitter, the operating elements, or the power supply.

20 Claims, 5 Drawing Sheets

U.S. PATENT DOCUMENTS

| | | | | |
|---|---|---|---|---|
| 5,001,962 | A * | 3/1991 | Schlegel et al. | 89/6.5 |
| 5,052,144 | A | 10/1991 | Ostor | |
| 5,343,795 | A * | 9/1994 | Ziemba et al. | 89/6.5 |
| 5,375,072 | A * | 12/1994 | Cohen | 702/94 |
| 5,659,148 | A | 8/1997 | Isgen | |
| 5,669,174 | A * | 9/1997 | Teetzel | 42/115 |
| 5,689,908 | A * | 11/1997 | Brandl | 42/77 |
| 5,856,631 | A * | 1/1999 | Julien | 89/16 |
| 5,894,102 | A * | 4/1999 | Oberlin et al. | 89/6.5 |
| 5,942,714 | A * | 8/1999 | Oberlin et al. | 89/6.5 |
| 6,012,374 | A | 1/2000 | Brandl et al. | |
| 6,070,512 | A * | 6/2000 | Rohrbaugh | 89/147 |
| 6,138,547 | A * | 10/2000 | Larsson et al. | 89/6.5 |
| 6,170,377 | B1 * | 1/2001 | Larsson et al. | 89/6.5 |
| 6,250,194 | B1 * | 6/2001 | Brandl et al. | 89/1.41 |
| 6,449,892 | B1 * | 9/2002 | Jenkins | 42/1.01 |
| 6,615,702 | B1 * | 9/2003 | Julien | 89/16 |
| 6,925,742 | B1 * | 8/2005 | Van Zyl | 42/70.01 |
| 7,021,187 | B1 * | 4/2006 | Grassi | 89/6.5 |
| 7,171,776 | B2 * | 2/2007 | Staley, III | 42/142 |
| 7,269,920 | B2 * | 9/2007 | Staley, III | 42/114 |
| 7,291,014 | B2 * | 11/2007 | Chung et al. | 434/11 |
| 2002/0050087 | A1 * | 5/2002 | Murello | 42/16 |
| 2004/0231220 | A1 * | 11/2004 | McCormick | 42/120 |
| 2005/0252062 | A1 * | 11/2005 | Scrogin et al. | 42/119 |

FOREIGN PATENT DOCUMENTS

| | | |
|---|---|---|
| DE | 4433627 | 3/1996 |
| EP | 0307308 | 3/1989 |
| EP | 0800050 | 10/1997 |
| EP | 1069394 | 1/2001 |
| FR | 2840398 | 12/2003 |

OTHER PUBLICATIONS

International Searching Authority, "International Search Report", for counterpart PCT application Serial No. PCT/EP2006/003590, mailed Aug. 11, 2006 (6 pages).

International Searching Authority, "International Preliminary Report on Patentability", for counterpart PCT application Serial No. PCT/EP2006/003590, mailed Nov. 8, 2007 (7 pages).

* cited by examiner

EXCHANGEABLE BARREL MODULES FOR FIREARMS

RELATED APPLICATION

This application is a continuation of International Patent Application Serial No. PCT/EP2006/003590, filed Apr. 19, 2006, which claims priority to German Patent Application 10 2005 019 594.6, filed Apr. 27, 2005, both of which are hereby incorporated herein by reference in their entireties.

FIELD OF THE DISCLOSURE

This disclosure relates generally to firearms, and, more particularly, to exchangeable barrel modules for firearms.

BACKGROUND

Firearms including exchangeable barrels and/or a variety of attachable accessories have been described in many publications. For example, U.S. Pat. No. 5,052,144 describes a weapon including a grenade launcher with drop barrel and shoulder support. In addition, U.S. Pat. No. 4,989,359 describes a weapon with an exchangeable barrel for shooting ammunition of various calibers. Furthermore, European Patent 1 069 394 B1, German Patent 44 33 627 A1, or U.S. Pat. No. 4,711,152 describe a weapon that includes an annular gap surrounding the barrel to accommodate electronic components on the outside of the barrel. Other such weapons are described in German Patent 42 14 059 A1, French Patent 2 840 398; European Patents 307 308 B1 and 0 800 050; and U.S. Pat. Nos. 4,142,442; 5,659,148; and 6,012,374 and the article titled "Future vision . . . " in the magazine "Soldat und Technik" [Soldier and Technology], volume 44, No. 11, November 2001, pages 34-39.

Large-caliber handheld firearms often include auxiliary barrels having a significantly smaller caliber than the original barrel and are used for practice purposes. Drop barrel weapons are weapons that the barrel or the bundle of barrels can be exchanged for another barrel or another bundle of barrels. The ballistic performance of an exchangeable or interchangeable barrel can be better than that of the original barrel. The interchangeable barrel can have a telescopic sight because there is typically unrestricted space above the barrel. However, if an additional weapon(s) or additional weapon accessories are used, for example, rifle grenade equipment, the space that accommodates the barrel and any interchangeable barrel may be limited to the dimensions of the original barrel. The additional weapons may be, for example, rifle grenade equipment that is placed underneath of the barrel of, for example, an automatic pistol. If rifle grenade equipment is used as the additional weapon, the space that accommodates the barrel and any interchanged barrel is restricted.

The restricted space above the barrel in the above-described weapons also may affect the development of intelligent ammunition that can be fired in highly complicated weapons, such as so-called intelligent weapons. Intelligent weapons include may additional components requiring more space around the barrel. Further, the barrel in these intelligent weapons cannot be made of a material (e.g., iron or nickel, etc.) that would impair the transmission of magnetic impulses from an induction coil to the projectile.

DETAILED DESCRIPTION

Figure 1:
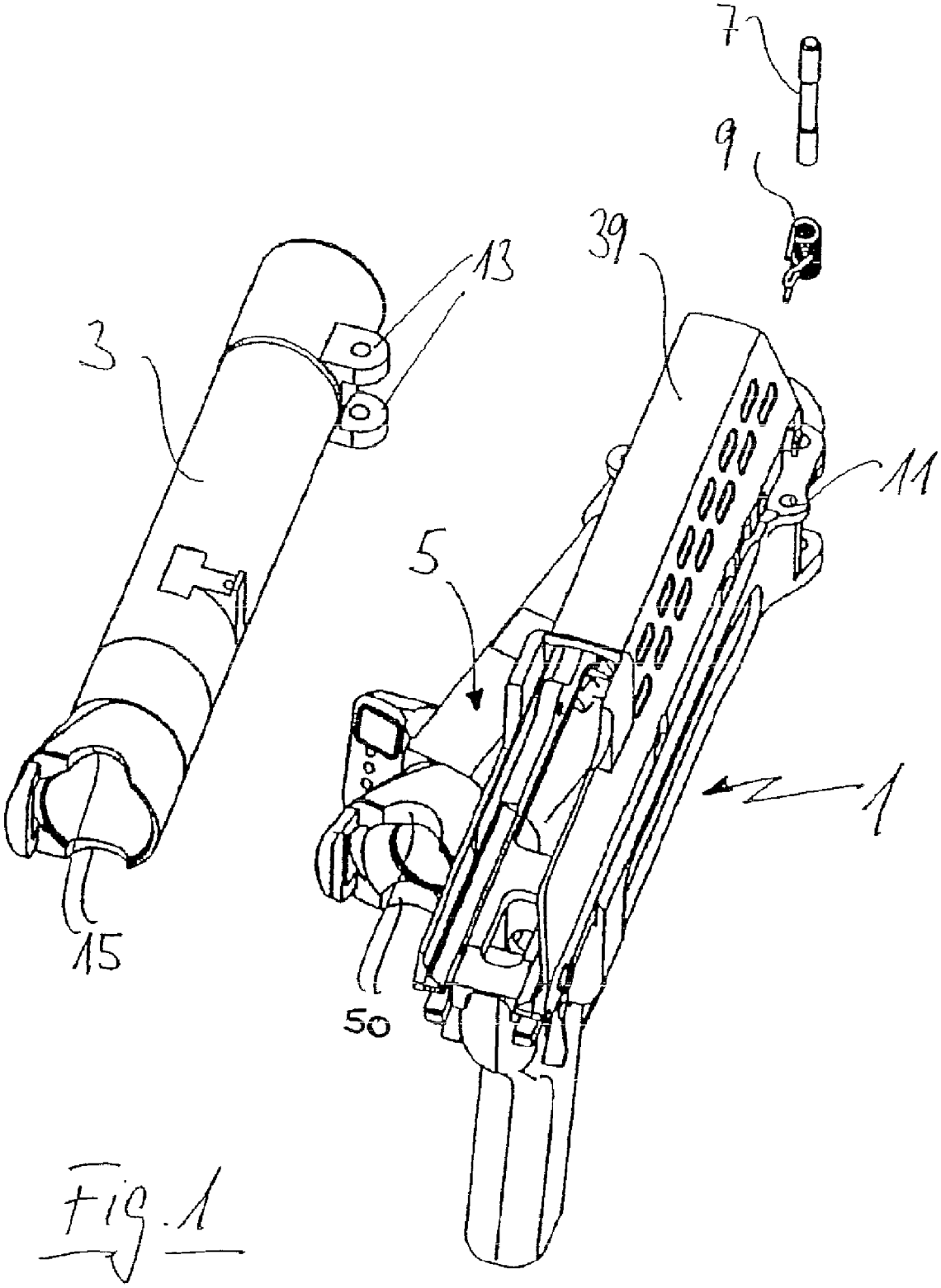
FIG. 1 illustrates a perspective view of a firearm that is being retrofitted by an example barrel with an example barrel jacket, wherein the removed conventional barrel is illustrated next to the firearm.

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

Intelligent weapons may include many additional components such as a laser range finder, an induction coil or contact programming, sighting electronics, and a power supply. Typically, the induction coil surrounds a rifled barrel at a cartridge chamber and is coupled to the range finder via a computer. The range finder transmits to the projectile the number of revolutions that the projectile will make before the intended target is reached. Further, the barrel in these intelligent weapons cannot be made of a material (e.g., iron or nickel, etc.) that would impair the transmission of magnetic impulses from the induction coil to the projectile. A barrel material such as titanium-based material or titanium itself is suitable for wireless programming by means of the magnetic impulses. However, ultra-sound impulses or other magnetic field-independent impulses could be applied instead of magnetic impulses and, therefore, may not be disturbed by a barrel made of iron and/or nickel. In such cases, instead of transmitting to the projectile the number of the revolutions that the projectile will make before the intended target is reached, the time interval between the discharge time and when the target is reached or other detonation time may be predefined.

Typically, the intelligent ammunition is a relatively small-caliber grenade (approximately a 25 mm cartridge) having relatively weak effect. However, because the small-caliber grenade can be programmed to detonate precisely in an intended place, the effect on the target can even surpass the effect of considerably larger grenades. For example, an enemy gunner surrounded by cover can be eliminated by aiming and firing (e.g., a small-caliber grenade) at a prominent point above the enemy gunner's position. After the small-caliber grenade has made the programmed number of revolutions, the small-caliber grenade will detonate precisely above the enemy gunner. The small-caliber grenade can be ignited before the target point (i.e., the point above the gunner) is reached; however, the small-caliber grenade will not detonate and release its full effect until the target point is reached. If the small-caliber grenade is ignited in the wrong place or if the firing position (the place at which firing from the weapon occurs) is offset horizontally to the front or the rear, electronics in the intelligent weapon can be manually adjusted and the weapon can be fired again. To allow for manual adjustment of the electronics, control buttons including a "reset" button are included, via which, firing position can be moved to the front or the rear, and if additional adjustment is necessary, electronics associated with the sight can be reset as well. A control button can be included to "freeze" the results from these reset adjustments. The freeze option may be selected if another position of the marksman must be used for aiming at a target, which may require the grenade to detonate at a different distance from that which previously may have been set at an auxiliary target.

The equipment (the sighting electronics, the range finder, and the power supply) for carrying out the above operations are usually separated from the barrel. Only the induction coil or the contact programming for transferring the information to the small-caliber grenade (i.e., the projectile) is arranged around the cartridge chamber, but these components are structurally separate from the barrel to simplify changing barrels. Batteries that are used to supply power to the electronics are typically placed in a shaft and the control buttons are typically located on the grip. Further, the range finder with the sighting electronics is slipped on the rifle to be easily exchangeable in the case of a malfunction. However, line faults in the electronics are still possible, which hinder the use of the weapon and, therefore, make the exchange necessary.

FIG. 1 illustrates a perspective view of an example firearm 1, which may be, for example, a rifle with a grenade launcher device, from which a conventional barrel 3, such as for example, a 40 mm barrel has been removed. The conventional barrel 3 may be hingeably coupled to the firearm 1 via a pin 7. The pin 7 engages a spring 9 that springably biases the conventional barrel 3 and causes the conventional barrel 3 to move to an open position. FIG. 1 depicts the pin 7 and the spring 9 in an exploded view. The conventional barrel 3 may be removed from the firearm 1 by removing the pin 7 from boreholes 11 on the firearm 1 and boreholes 13 on the conventional barrel 3 and then removing the conventional barrel 3 from the firearm 1. In the illustrated example, the example firearm 1 has been retrofitted with an example barrel module 5. Other examples may not require retrofitting where, for example, the firearm 1 is manufactured with the example barrel module 5. The barrel module 5 may be able to fire intelligent ammunition such as, for example, an intelligent 25 mm cartridge.

Figure 3:
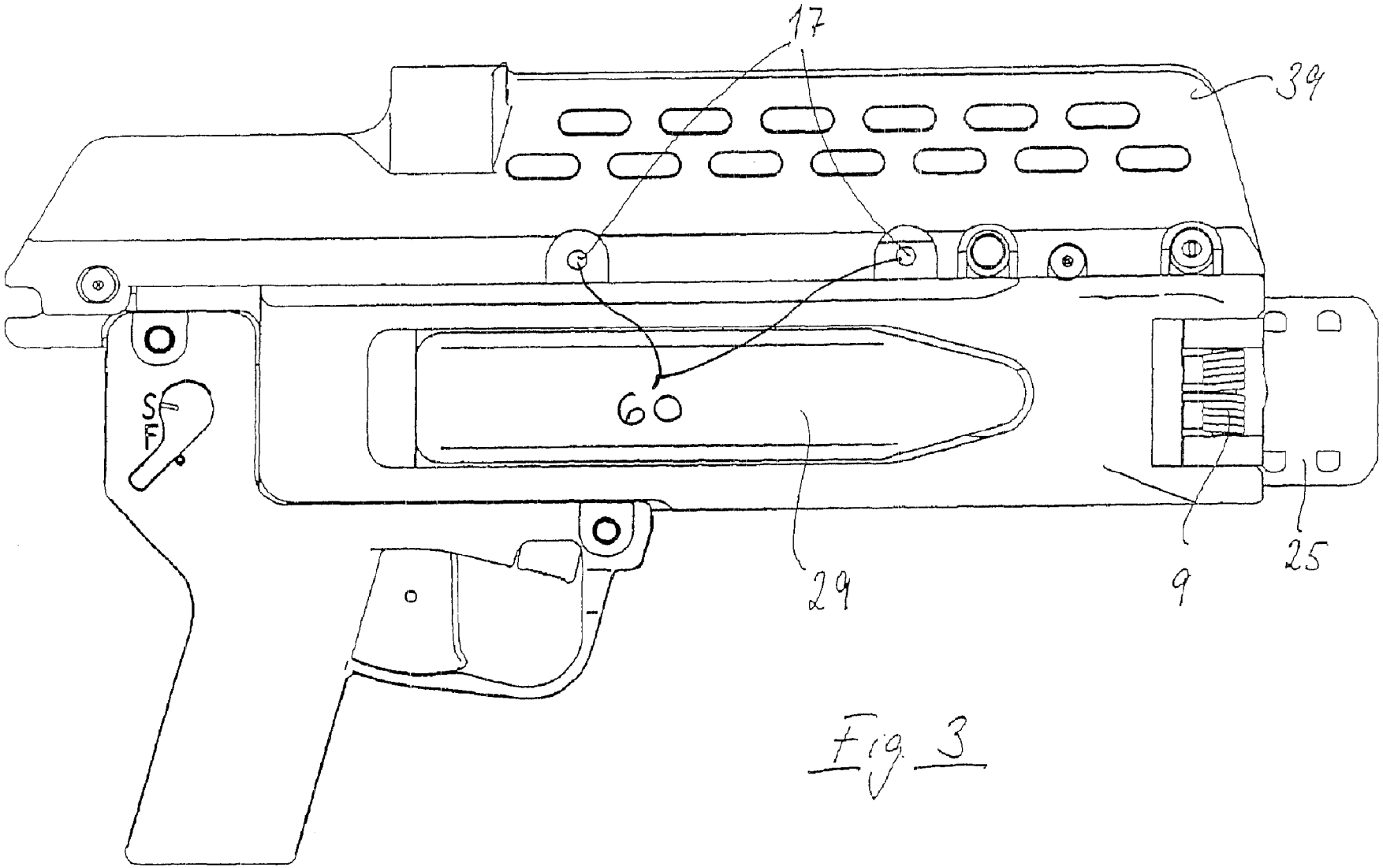
FIG. 3 illustrates a side view of the firearm of FIG. 1 with the example barrel in a closed position.

The conventional barrel 3 includes recessed clearance 15 toward the rear of the conventional barrel 3. Similarly, the barrel module 5 includes recessed clearances 50. The recessed clearances 50, 15 may allow the marksman to grasp and remove a fired cartridge case from the example barrel module 5 or of the conventional barrel 3 and, therefore, a separate ejector may not be necessary for either the barrel module 5 or the conventional barrel 3. After the conventional barrel 3 has been removed, or if no conventional barrel exists, the marksman may couple the barrel module 5 to the firearm 1, for example, by aligning boreholes (not shown) of the barrel module 5 with the boreholes 11 of the firearm 1 and inserting the pin 7 through the boreholes 11 of the firearm 1 and the boreholes of the barrel module 5 and also through the positioning of the spring 9. The spring 9 may surround the pin 7 and may be positioned between the boreholes 11 of the firearm 1 (FIG. 3). Once the barrel module 5 is coupled to the firearm 1, a cartridge may be inserted into the barrel module 5, the barrel module 5 may be moved along a curved or arcuate path from an open position to a closed position, and then the firearm 1 is ready to fire.

Figure 5:
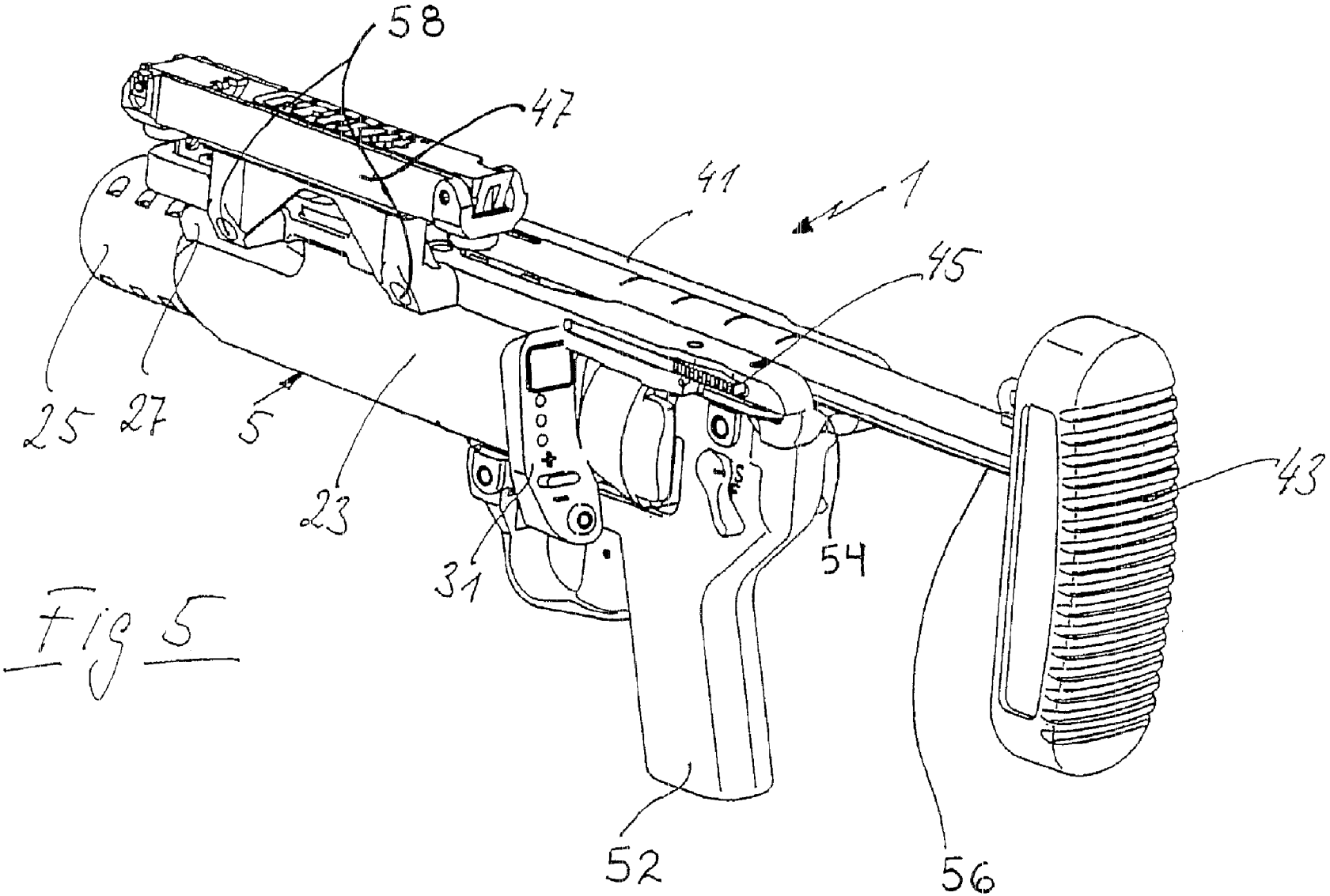
FIG. 5 illustrates the example firearm of FIG. 1 viewed from the left rear, with the example barrel in the closed position and including example accessories.

The illustrated example firearm 1 may include one or more attachments or accessories including, for example, a hollow attachment 39 that may be mounted in the place of a conventional hand guard (e.g., a hand guard mounted on an automatic pistol) and/or an exchangeable sights 47 (FIG. 5). The sights may include one or more sights such as, for example, a front sight and/or a rear sight. The attachment 39 and/or the sights 47, etc. may be coupled to the firearm 1 at boreholes 17 (FIG. 2), which may be, for example, threaded boreholes. Furthermore, the attachment 39 and/or the sights 47, etc. are interchangeable and may be exchanged for other attachments or accessories. The attachment 39, the sights 47 and any other attachment or accessory may be able to be used with both the conventional barrel 3 and/or the barrel module 5.

Figure 2:
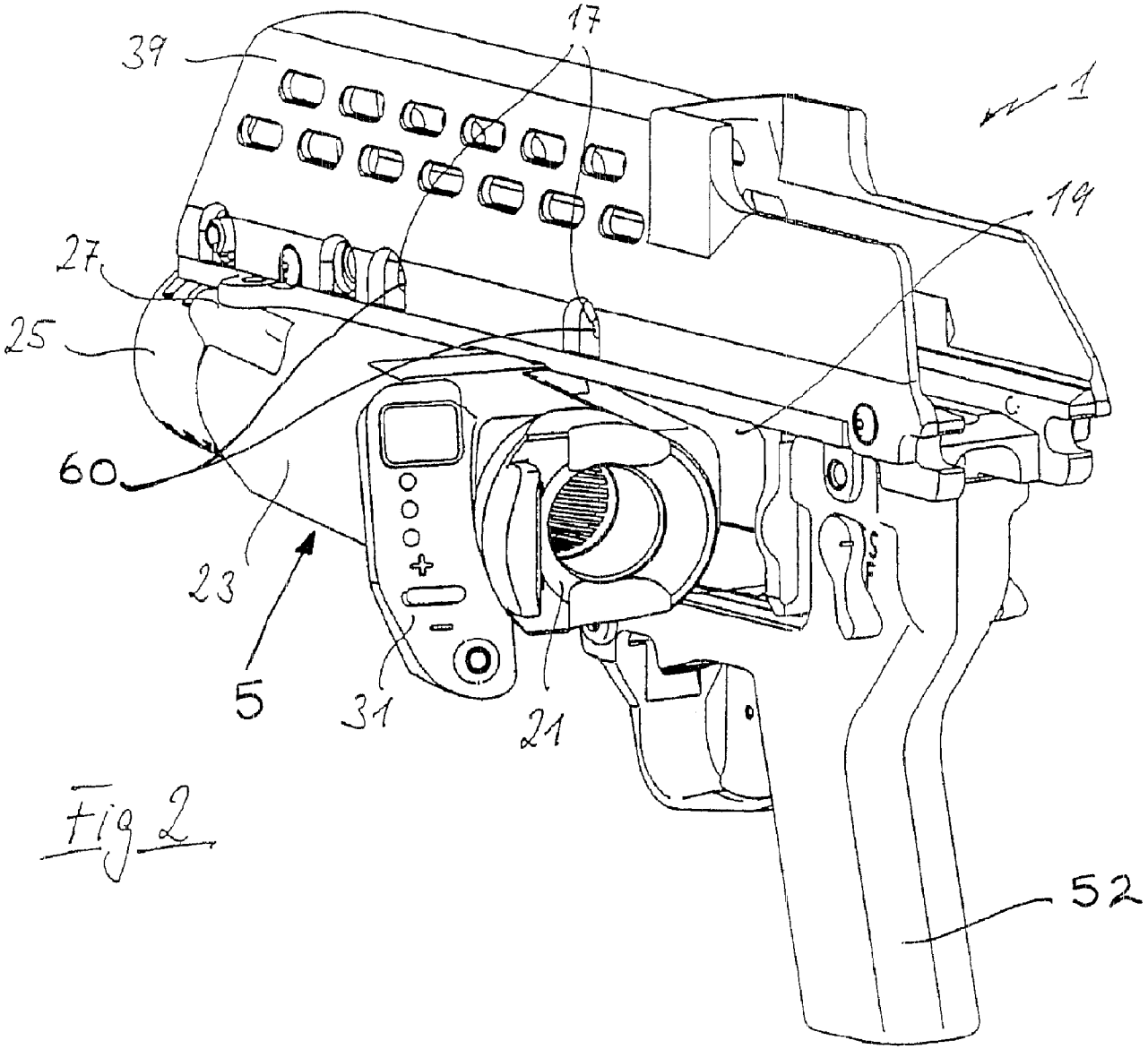
FIG. 2 illustrates a perspective view of the firearm of FIG. 1 with the example barrel in an open position.

FIG. 2 illustrates a perspective view of the firearm 1 with the example barrel module 5 in the open position. As shown in FIG. 2, the weapon housing of the firearm 1 may include a recess 19 on the right side that may reduce the overall weight of the firearm 1.

A barrel 21 of the barrel module 5 may be made of any suitable material such as, for example, a titanium-based material, titanium, etc. The barrel 21 may be inserted from the rear of the firearm 1 into a barrel jacket 23 and may be held in place from the front of the barrel 21 by a union nut 25. The barrel jacket 23 may be designed to fit in the housing of the firearm 1 in a substantially similar manner as the conventional barrel 3 (e.g., a 40 mm barrel). However, the barrel jacket 23 may have a substantially square cross-section with rounded corners instead of having a round cross-section that the conventional barrel 3 may have. A first protuberance or rangefinder 27 may be included on the upper left corner of the front side of the barrel jacket. A second protuberance (FIG. 3) may be included on the right side close to the rear end of the barrel jacket 23. The second protuberance 29 may penetrate the recess 19 if the barrel module 5 is in the closed position. The dimensions of the barrel jacket 23 may be configured in such a way that a more reliable seat may be achieved than was possible with the conventional barrel 3.

The size of the example barrel module 5 may exceed the size of the conventional barrel 3 because the barrel module 5 may include an example control unit 31. The control unit 31 may remain on the outside of the firearm 1 and, therefore, may not enter into the housing of the firearm 1 in either the open position (FIG. 2) or the closed position (FIG. 5). A switch, several control buttons or a contact and/or a display device may be positioned on the control unit 31, one or more of which may be used to, for example, instruct a marksman whether or not the electronics are switched on.

Figure 4:
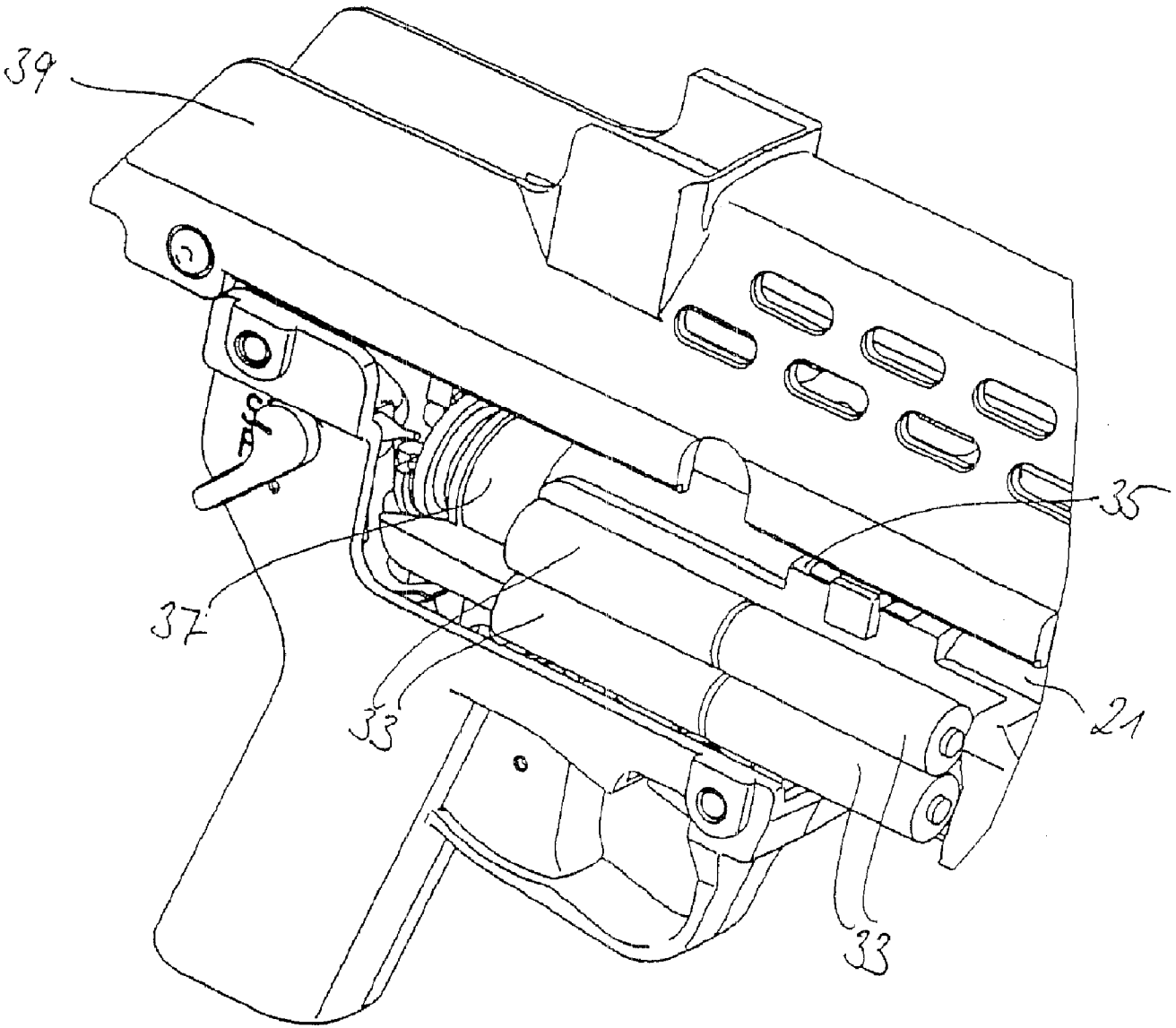
FIG. 4 is an enlarged perspective view of a portion of the firearm of FIG. 1 viewed from the right front without a barrel jacket.

FIG. 4 is a perspective view of a rear portion of the firearm 1 viewed from the right front without the barrel jacket 23. FIG. 4 clearly depicts the relationship between the barrel 21, a cartridge chamber 37, an induction coil 35, and a power supply 33 (e.g., batteries). The induction coil 35 may surround the cartridge chamber 37 of the barrel 21. The power supply 33 may be seated in the second protuberance 29 (FIG. 3). FIG. 4 does not include the range finder 27 nor does FIG. 4 include electronics for the sake of better definition. The electronics (e.g., control electronics) may be positioned in the remaining space within the barrel jacket 23.

FIG. 5 illustrates a perspective view of the firearm 1 from the left rear side in which the barrel 21 is in the closed position. The firearm 1 shown in FIG. 5 also includes the sights 47, and an example shoulder support 43. In addition, the attachment 39 (FIGS. 1-4) has been removed and an example rail 41 has been coupled to the top of the firearm 1. The rail 41 may also include a plurality of grooves 54 that may complement a plurality of bars 56 on the shoulder support 43. The plurality of bars 56 on the shoulder support 43 may be slid under the plurality of grooves 54 on the rail 41 from the rear of the firearm 1. The shoulder support 43 may be adjusted into a desired position by sliding the plurality of bars 56 farther into or out of the plurality grooves 54. The shoulder support 43 may be locked into the desired position by an example locking device 45. The sights 47 may be positioned centrally over the rail 41 and the marksman may couple the sights 47 to the firearm 1 by aligning the boreholes 17 of the firearm 1 with boreholes 58 of the sights 47 and inserting a plurality of fasteners 60 (FIG. 2) (e.g., screws, etc.) through the aligned boreholes 17, 58.

The barrel module 5 may be coupled to the firearm 1 at any time and may be in place of the conventional barrel 3. The installation of the barrel module 5 may be undone at any time as well. The length of the barrel 21 may be determined based on the firearm 1 such as, for example, whether the firearm is a rifle, a rifle with a grenade launcher etc. The length of the barrel 21 also may be based upon the interior ballistics of a cartridge. If the firearm 1 is retrofitted as, for example, an independent grenade rifle (FIG. 5), the barrel 21 may be longer and the union nut 25 may be adapted for the length of the barrel 21; however, the barrel jacket 23 may remain unchanged.

The barrel jacket 23 in the described examples may be made of any suitable material such as, for example, a synthetic material that may be light weight and economical to manufacture through the use of injection molding. Injection molding may allow for the solid casting of parts such as, for example, the range finder 27 into the barrel jacket 23, that may substantially seal the parts from environmental influences (e.g., field conditions, debris, contamination, etc.).

As described above, the barrel module 5, along with the barrel 21 and the surrounding barrel jacket 23, may be interchangeable as a unit and may hold at least part of the range finder 27, the electronics (e.g., the control electronics), a transmitter to transmit the results of the electronics to a projectile (e.g., a 25 mm cartridge), operating elements, and the power supply 33 (e.g., the batteries).

The firearm 1 may be formed in a substantially similar manner to a weapon that has a large caliber barrel (i.e., a large diameter), but may be otherwise a conventional weapon (i.e., that portion of the firearm 1 that does not include the barrel module 5). Typically, the firearm 1 may operate trouble-free for decades and, therefore, the firearm 1 (exclusive of the barrel module 5) may not include devices such as, for example, distance measuring devices, electronic devices, etc. However, the barrel jacket 23 may contain additional devices such as, for example, the range finder 27, electronic devices, etc. whose durability, during the course of improper storage may be compromised.

As described above, the barrel 21 and the barrel jacket 23 may be coupled together to form one exchangeable unit, and may be viewed as an interchangeable barrel. Even though the barrel 21 may have a smaller caliber (i.e., smaller diameter) than the conventional barrel 3, the barrel 21 may still be exchangeable with the conventional barrel 3 because the barrel jacket 23 fills up the possible remaining gap.

Components or equipment such as, for example, the electronics or miniaturized parts, whose durability under certain conditions (e.g., improper storage) may be decreased, may be placed at least partially in the barrel jacket 23 or may be surrounded by the barrel jacket 23 and, therefore, the barrel jacket 23 may protect the equipment against field conditions (e.g., rain, snow, sleet, sand, etc.). The equipment may be encompassed by the barrel jacket 23 and, therefore, mechanically coupled to the barrel jacket 23.

As described above, if a malfunction occurs in the equipment that may be located substantially in or partially in the barrel jacket 23, the barrel jacket 23 unit may be exchanged for another barrel jacket 23 unit at any time such as, for example, under field conditions by the marksman or by any other available individual. Malfunctioning equipment located in or partially in the barrel jacket 23 unit may be repaired at the company level (e.g., in-house, etc.) even if the malfunction originates from electronics, miniaturized parts, etc. because the malfunctioning equipment may best be repaired or replaced in a specialized workshop.

The barrel jacket 23 may be discarded if the interior is defective or for any other reason, and a new replacement barrel jacket 23 may be used in place of the defective barrel jacket 23. The barrel 21 may be detachable from the barrel jacket 23 and may be reusable even if the barrel jacket 23 is, for example, defective. Further, as described above with respect to the example of FIG. 2, to reuse the barrel 21, the barrel 21 may be detached from the defective barrel jacket 23, and then inserted into the rear of the new replacement barrel jacket 23 and may be held in place from the front of the barrel 21 by the union nut 25. As noted throughout this description the barrel 21 may be made of any suitable material such as, for example, a titanium-based material, titanium, etc. and, therefore, it may be cost effective to continue using the barrel 21 with the new replacement barrel jacket 23 after the barrel 21 has been removed from the defective barrel jacket 23. In the alternative, the barrel 21 may be conglutinates, glued and/or otherwise permanently coupled to the barrel jacket 23.

Conventionally, grenade launchers included a power supply in a buttstock of a weapon. In the illustrated example firearm 1, it is also possible to house the power supply 33 (e.g., the batteries) in a stock (e.g., the shoulder support 43). In addition, however, the power supply 33 also may be located in the barrel jacket 23 particularly where the power supply 33 may be capable of being stored for 10 years or longer and still operational for months at a time.

The power consumption of the equipment (e.g., the rangefinder 27, the control electronics, and the power supply 33 may be low if, for example, the marksman refrains from automatically adjusting the sights 47 in dependency with the range finder 27. In this case, the distance to the target point may be estimated and set in a substantially similar manner as the marksman may be accustomed to with the rifle. As described above, if the projectile detonates in the wrong place or if the firing position is offset horizontally to the front or the rear, the marksman may adjust the sights 47 and the firearm 1 may be fired again. The range finder 27 may work independently of the setting of the sights 47 setting, and the range finder 27 may determine the default setting on the number of revolutions or the flight time of the projectile until detonation. Further, because the projectile also may include an impact detonator, penetration of the projectile will be readily observed as the impact detonator will cause the projectile to detonate on impact when the projectile has not been detonated in the air by the built-in control system. Therefore, the sights 47 may be adjusted even at a great distances.

The barrel jacket 23 may have a diameter that is sufficient for the placement of the equipment (e.g., the electronics, the range finder 27, and/or the power supply 33, etc.) between the external diameter of the barrel 21 and the internal diameter of the barrel jacket 23. To prevent the barrel jacket 23 from becoming too thick and, consequently, to prevent the firearm 1 from becoming too unwieldy, the housing of the firearm 1 may include one or more recesses 19 (e.g., lateral recesses) next to, above or below the barrel 21 that may be penetrated by the barrel jacket 23 (e.g., if the barrel module 5 is in the closed position, etc.). The part of the barrel jacket 23 that may penetrate the housing of the firearm 1 may be designed as the second protuberance 29. As described above, the second protuberance may include the equipment that may be reached or accessed from the outside of the firearm 1 such as, for example, the power supply 33 that may supply power to the electronics.

The firearm 1, excluding the barrel module 5 and the recess 19, may be similar to a conventional firearm and, thus, may be formed as a semi automatic rifle or a drop barrel weapon. With some examples, a drop weapon may be particularly beneficial because the barrel of a drop barrel weapon may be at least partially exposed and, thus, the control unit 31 may be coupled to the barrel 21 or the barrel jacket 23 at these exposed areas.

The firearm 1 may be constructed, for example, as a rifle, a grenade launcher, etc., as noted above. In some examples, the dimensions of the firearm 1 may not significantly exceed the dimensions of a conventional firearm. The caliber of the barrel 21 (i.e., the diameter of the barrel 21) with the barrel jacket 23 may be smaller than what has been typically considered the minimum for such weapons; however, the smaller caliber does not translate to decrease power and effectiveness.

Consider that a conventional 40 mm firearm when firing at 300 meters may have an apex of trajectory of over 30 meters that requires an elevation of about 30 degrees. If a 40 mm projectile is fired at 350-400 meters with an elevation of about 30 degrees, the projectile will probably arrive; however, the 40 mm projectile may have a long flight time and may have an erratic impact behavior making the 40 mm projectile of a minimal use. Further, because of the large elevation angle, the 40 mm projectile may need different sighting devices that, for example, correspond more to a grenade launcher (with the German Federal Armed Forces: Mö_r_ser—heavy mortar).

However, in contrast, for example, the projectile of an intelligent cartridge (e.g., 25 mm caliber, etc.) that may have a comparable recoil to a 40 mm cartridge when firing at 300 meters may have less than three meters of super-elevation that corresponds to an elevation of few degrees. Further, the intelligent cartridge may be used when firing at 500 meters and may have a super-elevation of less than ten meters. The 25 mm caliber projectile's ability to precisely detonate at a distance may compensate for having about one quarter of the explosive quantity than is contained in the 40 mm projectile. Further, the intelligent cartridge may have a range that is nearly double that of the 40 mm cartridge and may have an extended trajectory and localized effect because the projectile may detonate at a predetermined location such as, for example, in the air. Air detonation may allow the intelligent cartridge to combat against, for example, helicopters, slow flying planes, etc. if the correct distance has been "frozen in" previously in the electronics or if the range finder 27 detects the aircraft. A marksman that is equipped with the firearm 1 that has been retrofitted with the example barrel module 5 and is able to fire an intelligent cartridge may become a serious annoyance or even a threat to, for example, a helicopter and may cause the helicopter to change course.

As described above, there are a number of firearms (e.g., grenade devices, etc.) that may be equipped with the barrel 21 with the barrel jacket 23 such as, for example, the firearm 1 described. The barrel 21 and the barrel jacket 23 are laterally swingable, which allows the control unit 31, when coupled to the outward swinging side of the barrel jacket 23, to be near a hand of the marksman (e.g., a hand that is loading the barrel 21 with a projectile or a hand that is located on a grip 52 of the firearm 1). Therefore, the marksmen may adjust the control unit 31 between shooting rounds. Further, in addition to the recess 19, the firearm 1, may include a slot that may have considerable space into which the barrel 21 and the barrel jacket 23 may swing from the open position to the closed position for the loading and/or unloading of projectiles and which may allow for the electronic devices to not be further miniaturized.

Further, as described above with respect to the example of FIG. 2, the firearm 1 may include the recess 19 positioned on the housing of the firearm 1 opposite the barrel 21. The barrel jacket 23 may include the second protuberance 29 that may engage the recess 19 when the firearm 1 is in the closed position (i.e., the firing position). The recess 19 may be formed of sheet metal and may be designed as an opening so that the second protuberance 29 (FIG. 3) may have a considerable radial expansion related to a barrel axis.

As discussed above, the second protuberance 29 may be disposed on the right side close to the rear end of the barrel jacket 23 and may hold the electronics and/or the rangefinder 27 (FIG. 3). In addition, the second protuberance 29 may be a battery compartment and may hold the power supply 33. Further, the power supply 33 may be accessible from the outside of the firearm 1, for example, by a detachable cover (not shown).

The barrel 21 may be removed from the barrel jacket 23, and the barrel 21 may be removed to change the power supply 33 (e.g., the batteries). Therefore, the barrel 21 may protect the second protuberance 29 housing the power supply 33 from, for example, penetrating wetness, or other environmental factors, etc.

The recess 19 and the second protuberance 29 may be positioned near a breach block (not shown) and, therefore, near the rear end of the barrel module 5. The power supply 33 (e.g., a battery pack, the batteries, or a battery, etc.) may be positioned near the center of gravity of the firearm 1, which would eliminate or minimize the effect on weapon operation.

As described above, the conventional barrel 3 may be coupled to the firearm 1. The conventional barrel 3 may not have the electronics, the barrel jacket 23, the range finder 27, the induction coil 35, the control unit 31, the power supply etc. However, the conventional barrel 3 may have an equal or greater caliber (i.e., larger diameter cartridge). The conventional barrel 3 may be coupled to the firearm 1 that may have, for example, a 40 mm barrel that may be able to fire a conventional grenade. Further, the conventional barrel 3 may be replaced with the barrel 21 and/or the barrel module 5 that may be able to fire intelligent ammunition that may be of a smaller caliber. Because, the firearm 1 may be equipped with either the conventional barrel 3 or the barrel module 5, the firearm 1 may be a cost-effective way for a police force, a military, etc. to experiment with either the conventional barrel 3 or the barrel 21 of the barrel module. In times of peace, a military, for example, is less likely to experiment with new weapons particularly if the costs are high. Because it is possible to equip a select number of units (or more depending on the militaries desire), regardless of the current armaments of the military, with the firearm 1 and the barrel module 5 by only supplying the barrel module 5 (because the firearm for the most part is conventional), a military can easily test the firearm 1 and the barrel module 5 without bearing excessive costs. The retrofitting of the military's current conventional firearms may be performed by the marksmen or a sergeant of the company armory. Further, the barrel modules 5 or the barrels 21 themselves may be coupled to or removed from the firearms as necessary and at any time. If the barrel module 5 is removed from the firearm 1, no additional material and/or equipment may be required to reequip the firearm 1 with the conventional barrel 3 because the conventional barrel 3 may still be available.

Further, the sights that may be used when firing the conventional barrel 3 may be exchanged for the sights 47 that may used when firing the intelligent ammunition. In the alternative, the sights may be designed as combined, switchable sights that may be able to be used with both the conventional barrel 3 and/or the barrel module 5.

Further, as described above with respect to the example of FIG. 5, the firearm 1 may include the shoulder support 43 if a shoulder support is not already present on the firearm 1. The shoulder support 43 may allow the firearm 1, retrofitted with the barrel 21 and the barrel jacket 23 that may be able to fire intelligent ammunition, to be, for example, an independent firearm. If the firearm 1 does not include a grip, the grip 52 may be coupled to the shoulder support 43 or may be coupled to the firearm 1.

This description relates to the example barrel 21 with the example barrel jacket 23 for the example firearm 1 that may be equipped with the same. The barrel 21 with the barrel jacket 23 may be able fire intelligent ammunition and the barrel 21 may be made of any suitable material such as, for example, a titanium-based material, titanium, etc.

In addition, a personal identification module, a device identification and/or a rounds counter may be integrated into the electronics that have been described above.

Furthermore, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A firearm comprising:

an exchangeable barrel module for the firing of intelligent ammunition comprising:

a barrel extending through a barrel jacket; the barrel jacket hingably coupled to a housing of the firearm and movable between a loading position and a firing position; and control elements including, a range finder, control electronics, a transmitter to transfer the result of the control electronics to a projectile, an operating element, and a power supply, wherein the barrel jacket holds the barrel, the range finder, the control electronics, the transmitter, the operating elements, and the power supply.

2. The firearm as defined in claim 1, wherein the barrel module further includes a display element.

3. The firearm as defined in claim 1, further comprising at least one recess in a housing adjacent to the barrel jacket that can be penetrated by the barrel jacket.

4. The firearm as defined in claim 3, wherein the barrel and the barrel jacket can be swung out laterally relative to the firearm, wherein the recess is positioned on the side opposite the swinging out of the barrel, and wherein the barrel jacket further includes a protuberance engaging into the recess when the barrel module is in a closed position.

5. The firearm as defined in claim 4, wherein the protuberance holds the power supply.

6. The firearm as defined in claim 5, wherein an the exchanged barrel is of equal or greater caliber than the barrel.

7. The firearm as defined in claim 1, wherein the firearm includes a rifle grenade device.

8. The firearm as defined in claim 1, wherein the firearm is a drop barrel weapon.

9. The firearm as defined in claim 1, wherein the barrel and the barrel jacket can be swung out laterally relative to the firearm, wherein the barrel jacket includes an outward swinging side, and wherein the operating element is coupled to the outward swinging side of the barrel jacket.

10. The firearm as defined in claim 1, further comprising a shoulder support.

11. The firearm as defined in claim 1, wherein the barrel module may be exchanged for an exchanged barrel that does not have at least one of the range finder, the control electronics, the transmitter, the operating elements or the power supply.

12. The firearm as defined in claim 1, wherein the barrel is made of a material that will not impair the transferring of magnetic impulses.

13. The firearm as defined in claim 1, wherein the barrel is made of a titanium-based material.

14. A barrel module for use with a firearm for the firing of intelligent ammunition comprising:

a barrel extending through a barrel jacket; the barrel jacket hingably coupled to a housing of the firearm and movable between a loading position and a firing position; and control elements, including a range finder, control electronics, a transmitter to transfer the result of the control electronics to a projectile, an operating element, and a power supply, wherein the barrel jacket holds the barrel, the range finder, the control electronics, the transmitter, the operating elements, and the power supply.

15. The barrel module as defined in claim 14, wherein the barrel module is exchangeable.

16. The barrel module as defined in claim 14, wherein the barrel module further includes a display element.

17. The barrel module as defined in claim 14, wherein the barrel jacket further includes a protuberance engaging into a recess on the firearm when the barrel module is in a closed position.

18. The barrel module is defined in claim 17, wherein the protuberance holds the power supply.

19. The barrel module as defined in claim 14, wherein the barrel is made of a titanium-based material.

20. The barrel module as defined in claim 14, wherein the barrel is made of a material that will not impair the transferring of magnetic impulses.

* * * * *